US006745562B2

(12) United States Patent
Berriman et al.

(10) Patent No.: US 6,745,562 B2
(45) Date of Patent: Jun. 8, 2004

(54) DIVERTER FOR CATALYTIC CONVERTER

(75) Inventors: Lester Berriman, Irvine, CA (US); John Zabsky, Santa Ana, CA (US)

(73) Assignee: KleenAir Systems, Inc., Irvine, CA (US)

( * ) Notice: Subject to any disclaimer, the term of this patent is extended or adjusted under 35 U.S.C. 154(b) by 0 days.

(21) Appl. No.: 10/244,454

(22) Filed: Sep. 16, 2002

(65) Prior Publication Data

US 2004/0050040 A1 Mar. 18, 2004

(51) Int. Cl.[7] ..... F01N 7/10

(52) U.S. Cl. ..... 60/324; 60/309; 60/299; 422/169; 422/170; 422/183; 181/225

(58) Field of Search ..... 60/296, 299, 309, 60/324; 422/168, 169, 183, 170; 181/225, 264, 258, 280, 281, 282

(56) References Cited

U.S. PATENT DOCUMENTS

| | | | | | |
|---|---|---|---|---|---|
| 3,838,977 | A | | 10/1974 | Warren | |
| 3,964,875 | A | | 6/1976 | Chang et al. | |
| 4,039,294 | A | | 8/1977 | Mayer et al. | |
| 4,183,896 | A | * | 1/1980 | Gordon | 422/168 |
| 4,328,188 | A | | 5/1982 | Kawata | |
| 4,374,803 | A | | 2/1983 | Fratzer et al. | |
| 4,383,974 | A | | 5/1983 | Fratzer et al. | |
| 4,601,168 | A | | 7/1986 | Harris | |
| 4,685,534 | A | * | 8/1987 | Burstein et al. | 181/251 |
| 5,150,573 | A | | 9/1992 | Maus et al. | |
| 5,185,998 | A | | 2/1993 | Brew | |
| 5,202,097 | A | | 4/1993 | Poussin | |
| 5,484,575 | A | | 1/1996 | Steenackers | |
| 5,904,042 | A | * | 5/1999 | Rohrbaugh | 60/298 |
| 5,962,822 | A | * | 10/1999 | May | 181/264 |
| 6,024,189 | A | * | 2/2000 | Heuser | 181/264 |
| 6,449,947 | B1 | * | 9/2002 | Liu et al. | 60/286 |
| 6,588,545 | B1 | * | 7/2003 | Lee | 181/264 |

FOREIGN PATENT DOCUMENTS

| | | |
|---|---|---|
| WO | WO 97/01023 | 1/1997 |

* cited by examiner

*Primary Examiner*—Binh Tran
(74) *Attorney, Agent, or Firm*—Leon D. Rosen

(57) ABSTRACT

A diverter (60) is provided, which is of low cost and which is effective in more evenly distributing exhaust gasses passing from a small diameter upstream exhaust gas pipe section (42) into a much larger diameter catalytic converter assembly (20). The diverter includes a diverter element (70) and mounting brackets (72). The diverter element has a central hole (82) and has conical walls with an included angle of at least 70°, the conical walls having a plurality of holes (90). The large conical angle (G) of the diverter effectively directs exhaust gases to the periphery of the large diameter catalytic converter but blocks a radially intermediate portion of the catalyst, while the holes in the conical diverter walls allow sufficient exhaust gases to reach the radially intermediate portion of the catalyst.

9 Claims, 2 Drawing Sheets

DIVERTER FOR CATALYTIC CONVERTER

BACKGROUND OF THE INVENTION

The exhaust systems of vehicles generally include a small diameter exhaust pipe section extending from an exhaust manifold to a catalytic converter of much greater diameter, with a conical transition pipe section connecting the downstream end of the small diameter pipe to the upstream end of the catalytic converter. To better distribute exhaust gases over the larger diameter catalytic converter, a diverter may be placed in the conical transition pipe section. Several different diverter designs have been proposed, but they have generally been of more than minimal cost and have not effectively distributed exhaust gasses evenly throughout the cross-section of the catalyst. A low cost diverter that evenly distributed exhaust gasses from the small diameter upstream pipe section to the much larger diameter catalytic converter, would be value.

SUMMARY OF THE INVENTION

In accordance with one embodiment of the present invention, an engine and a diverter for the exhaust conduit assembly of the engine are provided, which enables a more uniform distribution of exhaust gasses over the cross-section of the catalytic converter, using a diverter of very low cost. The diverter lies in a conical outer transition pipe section that connects the small diameter upstream pipe section to the much large diameter catalytic converter-holding pipe section. The diverter has conical diverter walls with an included angle of at least 70°, to divert considerable exhaust gasses to the peripheral portion of the catalytic converter. The diverter has a central hole to allow some of the exhaust gasses to flow to the center portion of the catalytic converter. The conical diverter walls have holes that allow considerable exhaust gasses to flow to an intermediate portion of the converter which lies between the central portion and peripheral portion.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
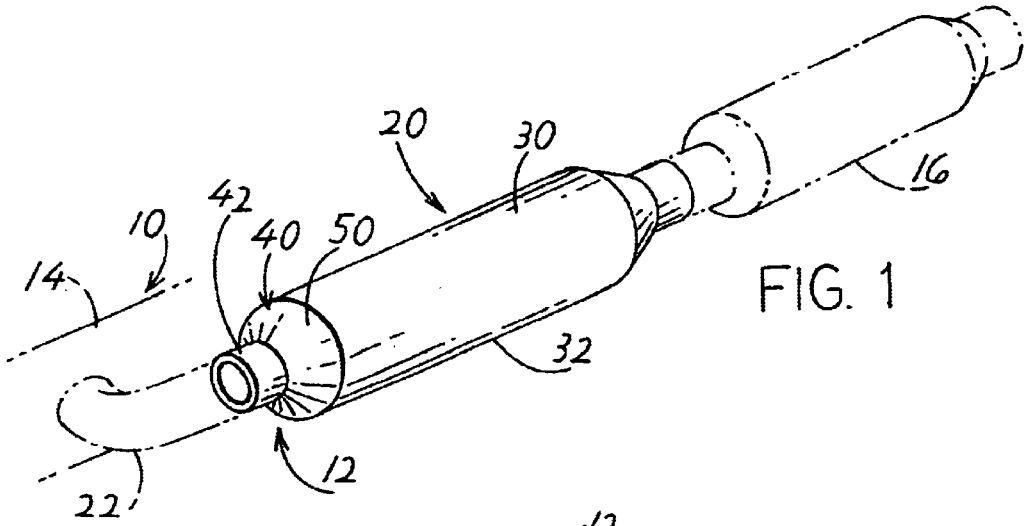
FIG. 1 is an isometric view of an exhaust conduit assembly of an engine, with upstream and downstream portions shown in phantom lines.
Figure 2:
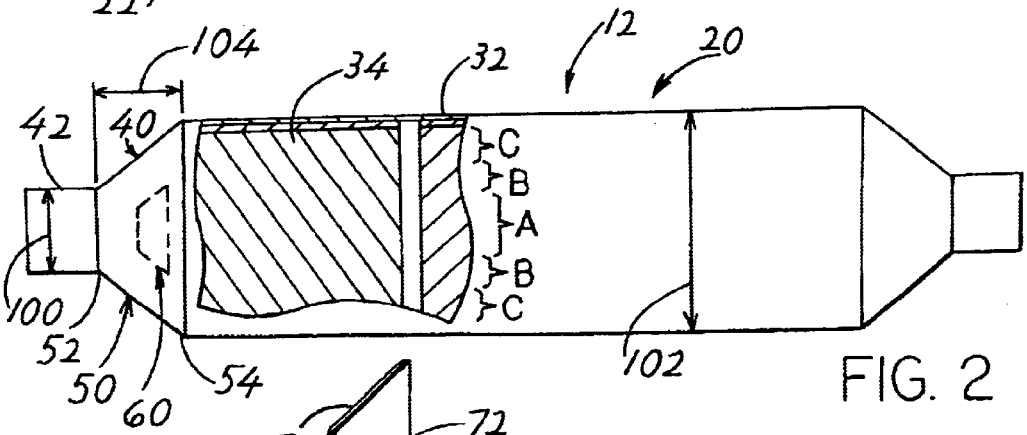
FIG. 2 is a partially sectional side elevation view of the catalytic converter assembly of the exhaust conduit assembly of FIG. 1.

FIG. 1 illustrates an exhaust conduit assembly 12 of an engine 10, which connects the exhaust manifold 14 through a muffler 16 to the atmosphere. A catalytic converter assembly 20 is placed along the exhaust conduit assembly to reduce pollutants in the final exhaust gasses that are released into the atmosphere. The conduit assembly includes an upstream pipe portion 22 which is of a small diameter such as two inches and which is unobstructed, and which carries the exhaust gasses to the converter assembly 20. The converter assembly includes a catalytic converter 30 that includes a substantially cylindrical catalytic converter-holding pipe section 32 of a much greater diameter than the upstream pipe portion 22. As shown in FIG. 2, the converter-holding pipe section 32 holds converter material 34 which has numerous small openings. The converter material 34, has a diameter that is usually about two to three times as great as an upstream pipe section 42 to provide a cross-sectional area about four to nine times as much. This results in lower resistance to gas flow therethrough and in slower gas flow therethrough. An upstream transition assembly 40 connects an upstream pipe section 42 of the converter assembly, which is of the same diameter as the upstream pipe portion 22, to the converter-holding pipe section 32.

The transition assembly 40 includes a truncated conical outer transition pipe section 50 with a small diameter upstream end 52 that is the same as that of the upstream pipe section 42, and with a downstream end 54 of the same diameter as the converter-holding pipe section 32. A diverter 60 lies within the outer transition pipe section 50.

The mass of catalytic converter material 34 may be said to have a central portion A, a ring-like peripheral portion C, and a ring-like radially intermediate portion B lying between the central and peripheral portions. In the absence of the diverter, some of the exhaust gases would reach each of the catalytic converter portions A, B, C. However, since the exhaust gasses move rapidly, their momentum would result in a much higher concentration of exhaust gasses reaching the upstream end of the central portion A than the peripheral portion C. This would reduce the effectiveness of the catalytic converter, which is most effective when the exhaust gasses are evenly distributed over the cross-sectional area of the upstream end of the converter material.

Although diverters have been used in the past, they have generally not been highly effective in uniformly distributing the exhaust gasses over the cross-section at the upstream end of the catalytic converter material 34. Also, prior art diverters have often been complex, resulting in a considerable cost. Because of the large number of engines in use, a small reduction in cost of construction of a diverter, is of considerable importance.

Figure 3:
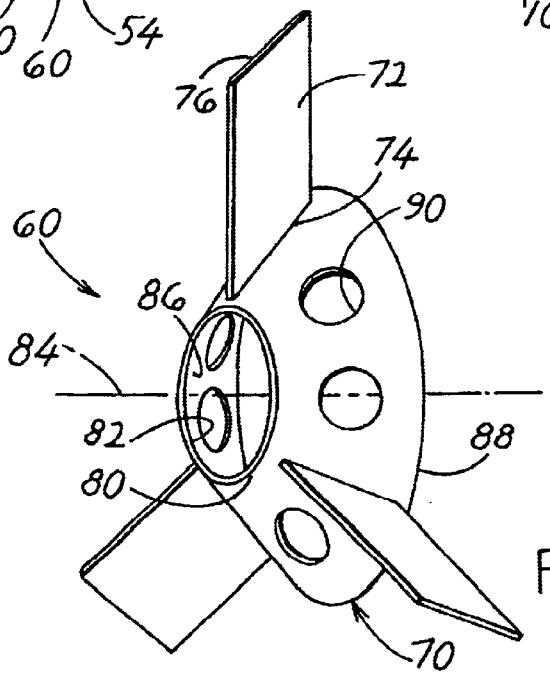
FIG. 3 is an isometric view of the diverter of the catalytic converter assembly of FIG. 2.
Figure 5:
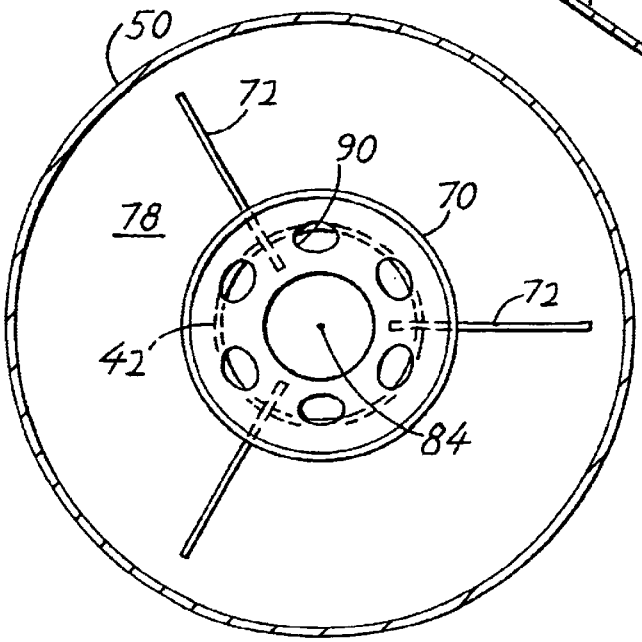
FIG. 5 is a view taken on line 5—5 of FIG. 4.

FIG. 3 shows that the diverter includes a diverter element 70 and a plurality of brackets 72 for mounting the diverter element 70 on the inside walls of the conical outer transition pipe section 50. The brackets are substantially uniformly angled about the axis 84, and divide the area about the diverter element into a plurality of passage portions 78 (FIG. 5). Each bracket preferably has an inner end 74 (FIG. 3) welded to the diverter element 70 and an outer end 76 welded to the inside walls of the outer transition pipe section 50. The diverter is in the form of a truncated cone. It has an upstream end 80 with a large hole 82 centered on the axis 84 of the diverter and on the conical outer transition pipe portion. The hole leads to a conical inside surface 86 with a large downstream end at 88. The diverter element has a plurality of holes 90 which aid in the even distribution of exhaust gasses.

Figure 4:
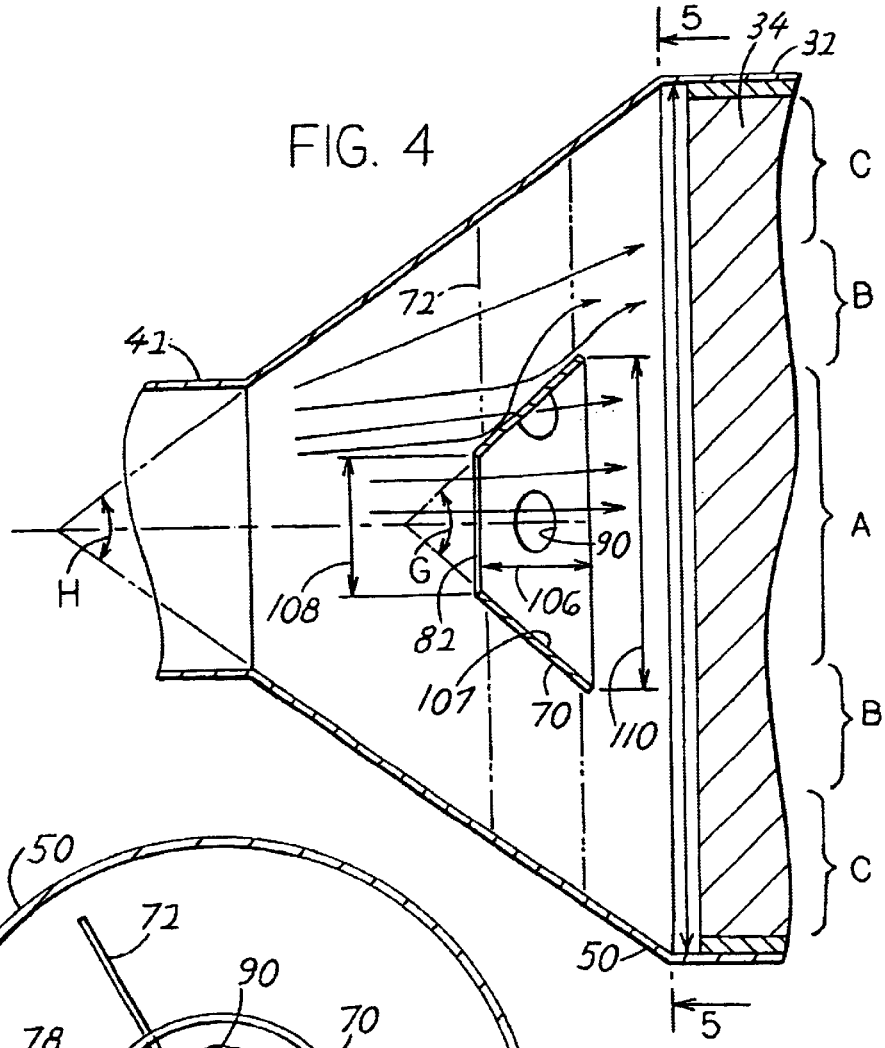
FIG. 4 is a sectional view of an upstream transition assembly of the catalytic converter assembly of FIG. 2, and also showing a portion of the upstream pipe section and the catalytic converter.

As shown in FIG. 4, the diverter element 70 has a large diversion angle, with the included angle G being at least 70°, and with the particular diverter illustrated having a diversion angle G of 85°. It is noted that this included diversion angle is slightly greater than the included diversion angle H of the outer transition pipe section 50 whose included angle of diversion H is 70°. The large diversion angle G of the diverter helps to deflect considerable exhaust gasses to the peripheral portion C of the catalyst material 34. The larger diversion angle G also narrows the downstream end of the passage around the diverter, which directs more gas through the holes. The central hole 82 allows considerable exhaust gasses to flow to the center portion A of the catalyst. The holes 90 allow considerable exhaust gasses to flow to the radially intermediate portion B of the catalyst material.

The diverter element 70 is preferably formed from sheet metal wherein the holes 90 have been punched out and the sheet metal has been deformed into the conical shape. The brackets 72 are then welded in place. It is possible to experiment with the flow of gasses through the upstream transition assembly 40. It is a relative simple matter to start with relative small holes and to enlarge the holes by metal cutting shears or the like and to retest, until an optimum size of the holes 90 and of the central hole 82 (which is increased by cutting away material at the narrow upstream end of the diverter) is found. An optimum diverter results in minimum amounts of the most undesirable polluting gasses dumped into the atmosphere. The diverters can be made at low cost with minimum tooling.

Applicant has designed an exhaust conduit assembly (FIG. 2) with a diverter 60 constructed for even distribution of exhaust gasses into the catalyzing material 34, wherein the upstream end of the outer transition pipe section 50 had a diameter 100 of two inches, the catalytic converter-holding pipe section 32 had a diameter 102 of 6.25 inches, and the length 104 of the outer transfer pipe section was 2.7 inches. Applicant constructed the diverter element 70 shown in FIG. 4, with a length 106 of 0.7 inch, a passage 107 with an upstream diameter 108 of one inch, and a downstream diameter 110 of 2.38 inch, the diversion angle G being 85°. Applicant provided six holes 90, each being circular and having a diameter of 0.42 inch. The area of the conical diverter element 70 was 5.3 $inch^2$ while the area of the six holes was 0.83 $inch^2$, or 16% of the area of the conical diverter element. The area (0.83 $inch^2$) of all holes is about equal to the area of the upstream end of the diverter central hole 82 (0.79 $inch^2$). As illustrated in FIG. 5, applicant used three mounting brackets 72 and used six holes 90, with two holes between each pair of adjacent brackets 72. It is desirable to provide at least one hole between every pair of brackets to more uniformity distribute exhaust gasses around the ring-shaped intermediate portions of the catalytic material. The diversion element and brackets can formed of a stainless steel material that is highly corrosion resistant to exhaust gasses, and which has a thickness such as 0.05 inch.

Thus, the invention provides an engine exhaust conduit assembly with a conical transition pipe section that connects a small diameter upstream pipe section to a much large diameter catalyst-holding pipe section, and a diverter lying within the transition pipe section to better distribute exhaust gasses to the catalytic material in the catalyst-holding pipe section. The diverter has a large expansion angle, the expansion angle being at least 70° and preferably at least 80 , and with a particular diverter described above having an expansion angle of 85°. The expansion angle is preferably greater than the expansion angle of the outer transition pipe section. Such a large diverter expansion angle results in considerable exhaust gasses being diverted radially outwardly to the peripheral portion of the large diameter mass of catalyst material and the blockage of a radially intermediate portion of the catalyst material. The center hole in the diverter allows sufficient exhaust gasses to pass through to the center portion of the catalytic material. The walls of the diverter element have holes that allow sufficient exhaust gasses to pass through to equalize the flow of exhaust gasses to the radially intermediate portion of the catalytic material. The holes preferably constitute at least 10% of the area of the diverter element, and preferably at least about 15% thereof.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In an engine which includes an exhaust conduit assembly with a catalytic converter-holding pipe section for holding a largely cylindrical mass of catalytic converter material having an axis, said mass having an axial portion lying close to said axis, a peripheral portion lying furthest from the axis, and a radially intermediate portion lying radially between said axial and peripheral portions, said exhaust conduit assembly including an upstream pipe section of smaller diameter than said converter holding pipe section, and an upstream transition assembly connecting said upstream pipe section to said converter-holding pipe section, wherein said transition assembly includes a conical outer transition pipe section that expands in a down stream direction and a diverter lying within said transition pipe section for more evenly distributing exhaust gas flowing into said largely cylindrical mass of catalytic converter material, said diverter having conical diverter walls that expand in a downstream direction and that are spaced from said conical outer transition pipe section, said diverter also having a central hole, the improvement wherein:

said conical diverter walls form an included angle of at least 70° and have a plurality of holes, whereby to more evenly distribute exhaust gasses to the radially intermediate portion of the catalytic converter material in a transition assembly of short length.

2. The improvement described in claim 1 wherein:

said holes in said conical diverter walls occupy at least 10% of the areas of said diverter walls in the absence of said holes.

3. The improvement described in claim 2 wherein:

said included angle of said conical walls of said diverter is at least 80° and said holes occupy at least 15% of the area of said diverter walls.

4. The improvement described in claim 1 wherein said diverter is formed of sheet metal with a diverter element of conical shape, and with at least three largely radially-extending brackets that are angularly spaced about said axis and that connect locations on said element to said outer transition pipe section and wherein:

said brackets divide a portion of the length of said outer transition pipe into a plurality of outer passage portions;

said plurality of holes in said diverter walls includes at least one hole lying angularly between each adjacent pair of brackets to allow exhaust gas to flow from inside said diverter into each of said outer passage portions.

5. The improvement described in claim 1 wherein:

the area of said central hole in said diverter at said upstream end of said diverter is about equal to the area of all of said holes in said conical diverter walls.

6. A diverter for placement in an upstream conical outer transition pipe section that connects a small diameter pipe section to a larger diameter catalytic converter-holding pipe section, compromising:

a sheet metal diverter element of primarily conical shape, said diverter element having an upstream end where the diameter of the diverter element is a minimum and a downstream end where the diameter of the diverter element is a maximum;

at least three brackets each having a radially inner end fixed to said diverter element and a radially outer end for fixing to said upstream conical outer transition pipe, so said brackets divide a region between said diverter element and said outer transition pipe section into passage portions;

said diverter element has a central hole and has conical walls with a plurality of holes therein, with at least one hole lying between each adjacent pair of said brackets, to allow exhaust gas to flow from inside said diverter element into each of said passage portions.

7. The diverter described in claim 6 wherein:

said diverter element of conical shape diverts at an inclusive angle of at least 70°, and said holes in said conical walls occupy at least 10% of the inside surface area of said diverter element.

8. A combination of an upstream conical outer transition pipe section with an axis and with a large diameter end that leads to catalytic material in a catalytic converter-holding pipe section, and a diverter that lies within said transition pipe section, said outer transition pipe section diverging at a first divergence angle wherein:

said diverter includes a truncated conical sheet metal diverter element having an upstream end where the diameter of the diverter element is a minimum and a downstream end where the diameter of the diverter element is a maximum, said conical diverter element diverting at a second divergence angle;

at least three brackets each having a radially inner end fixed to said diverter and a radially outer end fixed to said transition pipe section;

said second divergence angle is greater, by plurality of degrees, than said first divergence angle.

9. The combination described in claim 8 wherein:

said second angle is at least 70°, and including a plurality of holes in said diverter element lying downstream of said diverter element upstream end, the total area of all said holes is at least 10% of the surface area of said diverter element.

* * * * *